US006679624B1

(12) United States Patent
Mouawad

(10) Patent No.: US 6,679,624 B1
(45) Date of Patent: Jan. 20, 2004

(54) DEVICE FOR LOCKING THE WINDING BUTTON

(75) Inventor: Alain Mouawad, Geneva (CH)

(73) Assignee: Promomark SA, Villars-sur-Glane (CH)

( * ) Notice: Subject to any disclaimer, the term of this patent is extended or adjusted under 35 U.S.C. 154(b) by 0 days.

(21) Appl. No.: 09/551,045

(22) Filed: Apr. 17, 2000

(30) Foreign Application Priority Data

Apr. 27, 1999 (CH) ..... 0774/99

(51) Int. Cl.[7] ..... G04B 3/00; G04B 37/00

(52) U.S. Cl. ..... 368/216; 368/190; 368/288; 368/308; 368/319

(58) Field of Search ..... 368/310–323, 368/290–294, 189–199, 216, 281, 289, 206, 288, 306, 308, 319; 200/329

(56) References Cited

U.S. PATENT DOCUMENTS

D70,403 S * 6/1926 Conant ..... D10/131
1,961,734 A * 6/1934 Bieger ..... 368/281
4,313,187 A 1/1982 Waki et al. ..... 368/319
6,200,019 B1 * 3/2001 Latini ..... 368/289
6,210,034 B1 * 4/2001 Latini ..... 368/289

FOREIGN PATENT DOCUMENTS

| | | |
|---|---|---|
| CH | 139230 | 6/1929 |
| CH | 192185 | 9/1936 |
| FR | 2 740 881 | 5/1997 |

* cited by examiner

*Primary Examiner*—David Martin
*Assistant Examiner*—Jeanne-Marguerite Goodwin
(74) *Attorney, Agent, or Firm*—Clifford W. Browning; Woodard, Emhardt, Moriarty, McNett & Henry LLP

(57) ABSTRACT

When using wristwatches for diving or action sports, it is desirable to be able to prevent the winding button from being pulled out inadvertently and the time unintentionally altered. To avoid this, the button (3) has the overall shape of an H and a lever (2) engages in the groove (10) in said button (3) to prevent this button from being pulled out in error.

11 Claims, 2 Drawing Sheets

DEVICE FOR LOCKING THE WINDING BUTTON

Figure 1:
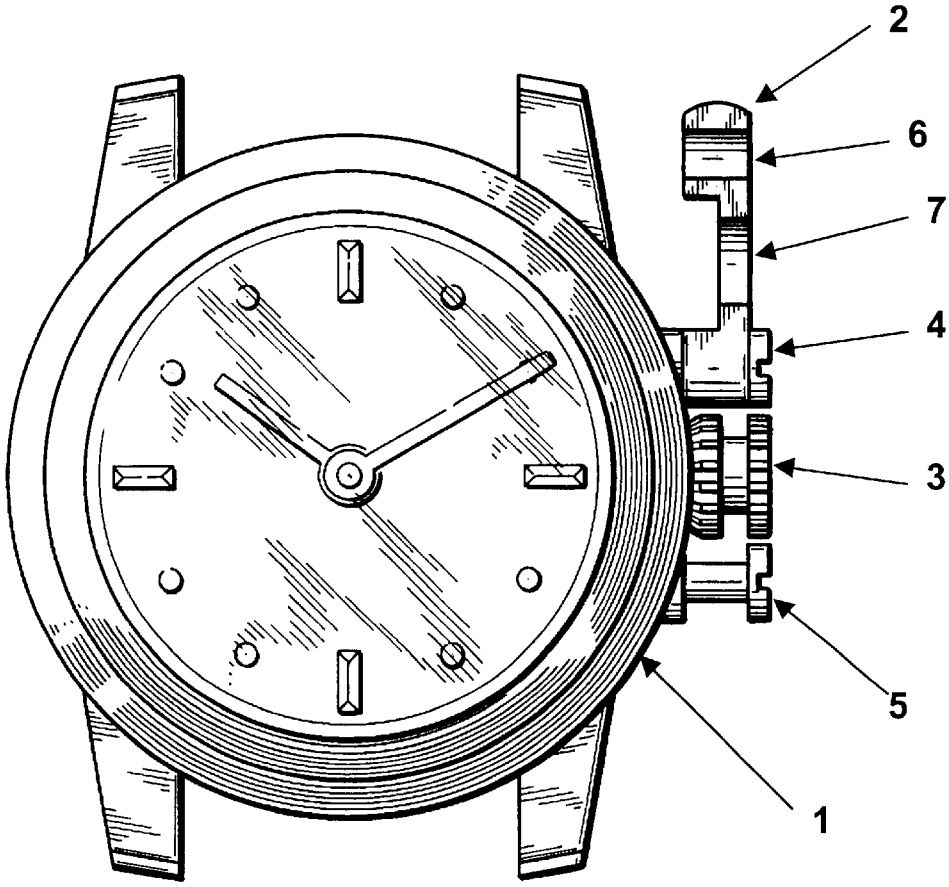

The present invention relates to the field of watchmaking, more particularly to a device for locking the mechanism for rewinding and setting the time of a watch.

Most watches, whether these be of the mechanical or quartz-driven type, necessarily need some mechanism for setting the time. In the case of mechanical watches, this mechanism also allows the input of external work needed for them to operate. This mechanism is actuated by an external button usually placed on one side of the watch and known as the winding button. This button allows access to the other functions offered by the watch, such as setting the date or changing the time zone.

When performing deep dives, the winding button is an area which is sensitive as far as watertightness is concerned, because the external pressure of the water on the casing is high and water may seep in past the winding button seals. What is more, it is possible during the dive that the wrist may strike an object and that the button may be pulled out inadvertently into its time-setting position. This has two serious consequences, one concerning the watertightness, which is reduced in this position, and the other concerning the possibility that the time setting might be altered or that the watch might stop. The latter consequence is particularly dangerous because a change to the time may cause accidents (incorrect calculation of the dive time and length of the decompression stops).

A widely used solution in the field of diving watches is the use of a screw-in winding button, that is to say that before making a dive, the winding button is screwed into the case. In order to allow the winding button to be turned in its function of rewinding the spring barrel, without engaging the screwed part of the winding button in the case, the button incorporates a spring which exerts pressure which holds the two threaded parts apart. To engage the screw thread of the button in the case, it is necessary to press the button against the case. In the screwed-in position, the button butts against the case, where an additional seal is usually fitted in order to provide good watertightness. While this solution guarantees good protection against the two aforementioned problems, it has the disadvantage of requiring an operation prior to diving, without which it is completely ineffective.

Another solution has been developed and uses a special bridge surrounding the winding button, which has a lever which presses the winding button against the case. This solution is found, in particular, on Italian Panarai® diving watches.

This solution, although it gives good results from a technical standpoint, is bulky and makes the watch slightly wider.

The object of the present invention is to be able to have a compact mechanism that locks the winding button in its position of rest, that is to say in the position for rewinding the spring barrel, and thus prevents the button from being pulled out at an inopportune moment.

The object of the invention is achieved through the use of a winding button with a central internal groove and a lever, the central part of which rests on this groove.

The special shape, known as the H-shape, of the winding button makes it possible to obtain very compact locking which does not exceed the length of the button. The central part of the lever lies across the groove that the small diameter of the H forms. One of the ends of the lever can rotate on a pin and the other end is locked on the other side of the button. Thus, when the lever is in place, it forms a rigid assembly extending from the rotation pin, passes between the two flanges of the button, and ends on the fastener.

Fastening may be achieved in various ways, for example by clipping onto a pin.

The button can be turned by hand by the teeth on the periphery of the two flanges.

The advantage of this solution is its simplicity, its robustness and its elegance. It locks the button in place at all times because it is not possible to leave the lever open, something which is not the case with the screw-in button, for example.

Figure 2:
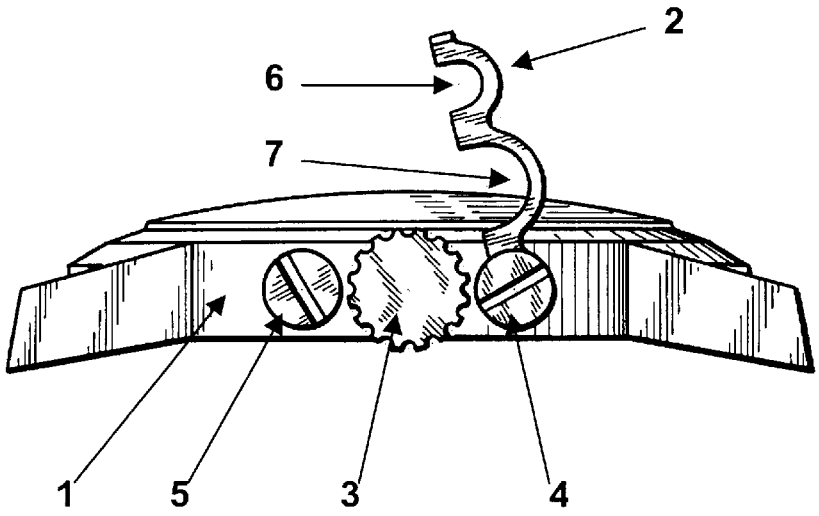
Figure 3:
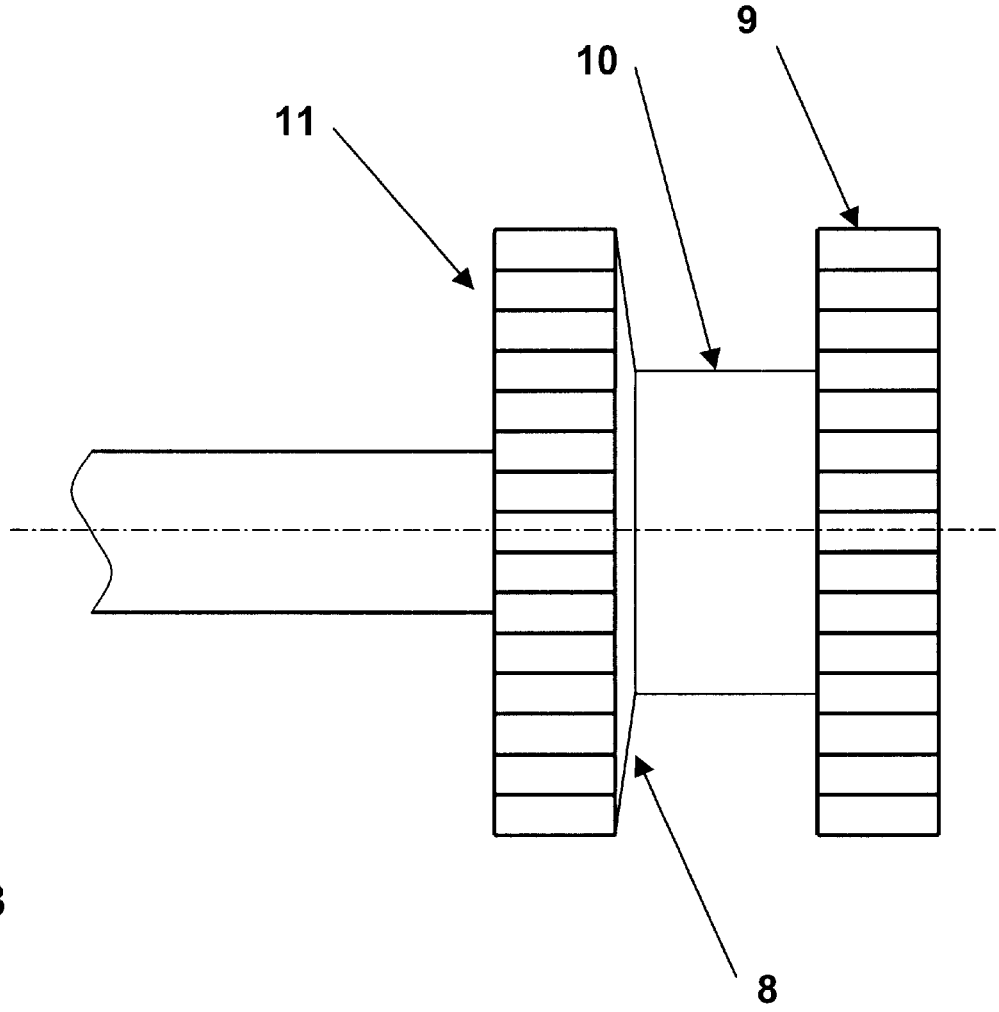

The invention will be better understood by virtue of the detailed description of the drawings, which do not in any way imply any restriction, and in which:

FIG. 1 is a view from above of a diving watch with the locking lever in its open position, FIG. 2 is a profile view of this watch, also with the lever in the open position, FIG. 3 is a profile view of an alternative form of the winding button.

In FIG. 1, a winding button 3 is mounted on the case of the watch 1. This button 3 has a groove of smaller diameter at its center to allow a lever 2 to pass. At one end, this lever is secured to a first pivot 4, and at the other end it can clip onto a second pivot 5. These two pivots are mounted in the case one on each side of the button, either by being screwed in or by clinching. Thus, the central part of the lever 7 sits between the two toothed flanges of the winding button 3, following the shape of its central groove, preventing said button 3 from moving longitudinally. The final part of the lever 6, for its part, sits over the pivot 5, thus giving the assembly good mechanical robustness.

FIG. 2 shows the layout of the two pivots 4 and 5 depicted in their screwed-in embodiments. It should be noted that in order for it to be possible for the part 6 of the lever 2 to clip correctly onto the pivot 5, the shape of the lever 6 needs to slightly exceed the diameter of the pin of the pivot 5 so that it can come back under it and thus act as a retainer. In another embodiment, instead of clipping onto the pin of the pivot 5, retention is achieved on the groove of the winding button, by the part 7 of the lever 2.

FIG. 3 shows an alternative form of the winding button 3, comprising an outer flange 9, an inner flange 11 and the central groove 10. The special feature of this button is that, on the internal face of the inner flange 11, it has a slight bevel 8. Thus, when the lever 2 is flipped into place, the central part 7 inserting between the two flanges 9 and 11 slides along the bevel 8 and exerts pressure on the button 3 which is pushed in against the case. Not only is the winding button 3 unable to move longitudinally, but it is also kept pressed into its winding position, thus guaranteeing excellent watertightness.

This type of embodiment, although initially intended for diving watches, is not restricted to this application and may be applied to any type of watch given the benefit that may be had from locking the winding button. Specifically, this locking may be proposed for watches not intended for diving but intended, for example, for action sports, and for which it is desirable to add this option of locking this button.

Various alternative versions of the present invention may be envisaged, particularly omitting the outer flange 9 which does not directly contribute to locking the winding button 3. It is also possible to prevent the winding button from rotating by making the groove 10 of the winding button in a shape other than cylindrical, for example with teeth or with a polygonal shape. Thus, the central part 7 of the lever 2, of the same shape, comes opposite the teeth or flats of the groove 10 in the winding button and thus prevents turning.

What is claimed is:

1. In a watch comprising a winding button mounted on a watchcase for movement from a pushed-in winding position to a pulled-out winding position, a device for locking the winding button in its winding position, said device comprising:

an external groove extending around the periphery of the winding button; and a lever pivotally mounted externally on the watchcase between a locking position in which the lever engages the peripheral groove of the winding button to lock said winding button in its winding position, and a disengaged position in which the lever is free from said peripheral groove to allow the winding button to be moved between its winding position and pulled-out position.

2. The device as claimed in claim 1, wherein the lever rotates about a pin at one of its ends, has locking means at its other end, and its central part rests in the peripheral groove in the winding button.

3. The device as claimed in claim 2, wherein the locking means comprise a fixed pivot and the end part of the lever is shaped to allow said lever to clip onto the pivot.

4. The device as claimed in claim 3, wherein the winding button comprises an inner flange and the connection between the interior face of said inner flange and the peripheral groove is of frustoconical shape.

5. The device as claimed in claim 3, wherein the locking means consist of the peripheral groove in the winding button and the central part of the level is shaped to allow said lever to clip over the peripheral groove.

6. The device as claimed in claim 2, wherein the peripheral groove in the winding button and the central part of the lever are of polygonal shape.

7. The device as claimed in claim 6, wherein the winding button comprises an inner flange and the connection between the interior face of said inner flange and the peripheral groove is of frustoconical shape.

8. The device as claimed in claim 2, wherein the locking means consist of the peripheral groove in the winding button and the central part of the lever is shaped to allow said lever to clip over the groove.

9. The device as claimed in claim 2, wherein the winding button comprises an inner flange and the connection between the interior face of said inner flange and the peripheral groove is of frustoconical shape.

10. The device as claimed in claim 1, wherein the winding button comprises an inner flange and the connection between the interior face of said inner flange and the peripheral groove is of frustoconical shape.

11. A watch comprising the device for locking the winding button as claimed in claim 1.

* * * * *